United States Patent [19]

Pao et al.

[11] Patent Number: 4,796,821

[45] Date of Patent: Jan. 10, 1989

[54] CUTTING APPARATUS FOR LIVING PLANT MATERIALS

[75] Inventors: Liem T. Pao; Yeong H. Yuen, both of Singapore, Singapore; Dan T. Wu, Surabaya, Indonesia

[73] Assignee: P. T. Panamas, Denpasar-Bali, Indonesia

[21] Appl. No.: 890,598

[22] Filed: Jul. 25, 1986

[51] Int. Cl.[4] ..... B02C 1/00

[52] U.S. Cl. ..... 241/101.2; 83/356.2; 83/734; 241/271; 241/283

[58] Field of Search ..... 241/271, 223, 245, 283, 241/264, 101.2; 83/356.2, 334

[56] References Cited

U.S. PATENT DOCUMENTS

| | | | |
|---|---|---|---|
| 480,638 | 8/1892 | Tarr | 83/356.2 |
| 840,416 | 1/1907 | Aptekman | 241/271 |
| 3,118,337 | 1/1964 | Ferris | 83/734 X |
| 3,185,196 | 5/1965 | Ward | 241/223 X |
| 3,709,274 | 1/1973 | Marek et al. | 241/223 X |
| 4,401,205 | 8/1983 | Komossa et al. | 241/223 X |
| 4,467,970 | 8/1984 | Sagemuller | 241/223 X |

FOREIGN PATENT DOCUMENTS

| | | | |
|---|---|---|---|
| 698314 | 11/1940 | Fed. Rep. of Germany | 241/271 |

*Primary Examiner*—Mark Rosenbaum

*Attorney, Agent, or Firm*—Fliesler, Dubb, Meyer & Lovejoy

[57] ABSTRACT

A reciprocating cutting apparatus for cutting living plant material. The cutting apparatus includes a frame. A reciprocating cutting assembly is mounted at one end of the frame for cutting the materials. The frame includes structure for synchronizing the feeding of the materials with the cutting assembly. The living plant material is fed into the cutting assembly in the upward stroke and held still on the downward or cutting stroke. The cutting assembly can be adjusted for cutting the desired strip width of living plant material. The cutting apparatus further includes structure mounted on the frame which applies pressure to the living plant material just prior to the living plant material being cut.

8 Claims, 5 Drawing Sheets

CUTTING APPARATUS FOR LIVING PLANT MATERIALS

BACKGROUND OF THE INVENTION

1. Field of the Invention

This invention relates generally to a production cutting apparatus and more particularly to a cutting apparatus for cutting living plant materials.

2. Description of Prior Art

The cutting of green plant material presents certain special difficulties. For example, in preparing tobacco for use in the making of cigarettes, great care must be exercised when cutting tobacco leaves that are living. The leaves are wet and green and can have a moisture content of 80 percent or more. In addition, green leaves are fragile and come in non-uniform dimensions. The use of loading hoppers or coil feed systems such as employed in the prior art for dried tobacco is not suitable because of the fragile and living nature of green leaves. As leaves are fed into the loading hoppers, the bottom leaves are crushed. With dry tobacco leaves, this crushing force is acceptable because there are no living cells or essential fluids in the leaf. However, green tobacco leaves contain living cells and essential fluids, which will flow upon crushing destroying the high quality of the leaves. Additionally, mechanical damage such as tearing of the leaf can occur by being crushed in a loading hopper. The mechanical damage will adversely affect the ability to obtain clean cuts from the green tobacco leaves necessary for the proper curing of the leaves for use in cigarettes.

Coil feed systems similarly damage the green tobacco. Coil feed systems, which are described below in further detail, exert sharp local pressures at the various turns or coils in the feed system. These sharp local pressure points cause the living cells and essential fluids of green tobacco leaves to flow. Additionally, leaves going through the coil feed system tend to become frayed and otherwise mechanically damaged, thereby adversely affecting their quality.

If the leaf cells are damaged, leaves will turn dark brown rather than the preferred yellow and orange after aging. This discoloring of the leaves, lowers the quality of the leaves dramatically. Thus, a high quality green leaf may be lowered in quality and no longer suitable for making quality cigarettes because it has turned dark brown or has other discoloration present.

Similarly, the tearing of leaves will lower quality. In order to make cigarettes using tobacco leaves aged after cutting, the leaves must have clean cuts of generally uniform and predetermined strip widths. When the leaf is torn or otherwise damaged, cigarette production from such leaves is adversely affected.

It is also important to have a clean cut of the leaves so that the cells of the leaves are not damaged in any way. Damaging the cells of the leaves results in the lowering of quality of the tobacco leaves. Cell damage causes the juices to flow and discoloration as well as mechanical damage to the leaves.

Presently, tobacco leaves are cut manually after they have been specially bundled and folded. The bundles must be folded by a skilled laborer and in a certain fashion so that when the leaves are cut they are cut cleanly and in a generally uniform manner. It will be appreciated that there is considerable skill required, not only in the folding of the bundles, but also in the cutting of the bundles. The skilled artisans and the amount of time involved in production causes these cigarettes to be quite costly, presently. To date, no non-manual cutting apparatus has been developed which cuts uniform strip widths without damaging the fragile green tobacco leaves.

It has been long recognized that there are certain difficulties in cutting tobacco leaves. For example, in U.S. Pat. No. 840,416 issued in 1907, it was found desirable to have a mechanical device which cut tobacco leaves from a hopper above a conveyor and which then fed the tobacco through a series of rollers to a cutting knife. This is acceptable for dry tobacco leaves because they contain no living cells and essential fluids, so pressure points and even crushing do not adversely affect the quality of the leaves. However, green tobacco leaves which do contain living cells and essential fluids are quite different as pointed out above. Any attempt to feed green tobacco leaves through a series of rollers would result in severe mechanical damage and cause the living fluids to flow dramatically lowering the quality of the leaf and adversely affecting cigarette production.

Another patent, namely, U.S. Pat. No. 480,638, discloses the problem of clogging cutting blades.

Other prior devices, namely, U.S. Pat. No. 995,465 which shows a machine for dividing a ribbon into pieces of uniform length which has upper and lower drive belts for feeding and U.S. Pat. No. 840,416 which provides fixed rollers for feeding tobacco are not suitable for cutting green tobacco leaves. Each of these above references are inflexibly configured which could result in pressure that will damage or tear the green tobacco leaves.

No prior cutting device has been found which will allow the continuous loading of living green leaves onto a feed apparatus, where the leaves will be cut into generally uniform strips with each strip having a clean cut so that a minimum of damage to the living plant material occurs. Accordingly, there is a need for a machine that will produce a consistent cut of green leaves at a predetermined width, without requiring skillful folding of the leaves, to increase production rate for cutting.

SUMMARY OF THE INVENTION

It is a general object of this invention to provide a cutting apparatus which permits continuous loading of green leaves for cutting into generally uniform and clean strips.

It is a further object of this invention to provide cutting apparatus which includes a pressure arm for applying gradually increasing pressure on the green leaves just prior to the living plant material being cut into strips.

It is a further object of this invention to provide a cutting apparatus which will cut whole green tobacco leaves into strips of a predetermined width while maintaining the high quality of the tobacco.

It is a further object of this invention to provide a cutting apparatus which can operate continuously without the constant need for sharpening of the cutting apparatus.

It is a further object of this invention to provide a cutting apparatus which will cut green leaves with a minimum loss of natural fluids.

The structure of the cutting apparatus in accordance with this invention which accomplishes the objects of the invention as set forth above and as will be more fully appreciated hereinafter, comprises a frame, means mounted at one end of the frame for cutting the leaves having a reciprocating blade mounted on the frame and synchronous with the reciprocating blade means for feeding leaves into the cutting means at the appropriate times for cutting predetermined widths of living plant material; and means hingedly mounted on the frame for applying pressure to the leaves entering the cutting plane of the cutting means.

The present invention provides substantial improvements over prior art tobacco cutting machines by coupling the feeding means with the reciprocating blade through a reciprocating rod connected to a clutch asembly for driving the feeding conveyor. By means of a stop nut on this reciprocating rod, the angle of rotation of the clutch assembly driving the conveyor and its relation to the upward assembly of the blade can be finely adjusted.

The cutting apparatus in accordance with this invention has the advantage of cutting living plant material into generally uniform strips with a minimum of crushing, tearing or other damage.

The invention has the additional advantage of accommodating stacks of materials of varying heights to facilitate continuous loading of materials onto the cutting apparatus.

These and other objects and advantages of the invention will be more fully appreciated hereinafter with reference to the drawings and the detailed description below.

DETAILED DESCRIPTION OF THE PREFERRED EMBODIMENT

Figure 1:
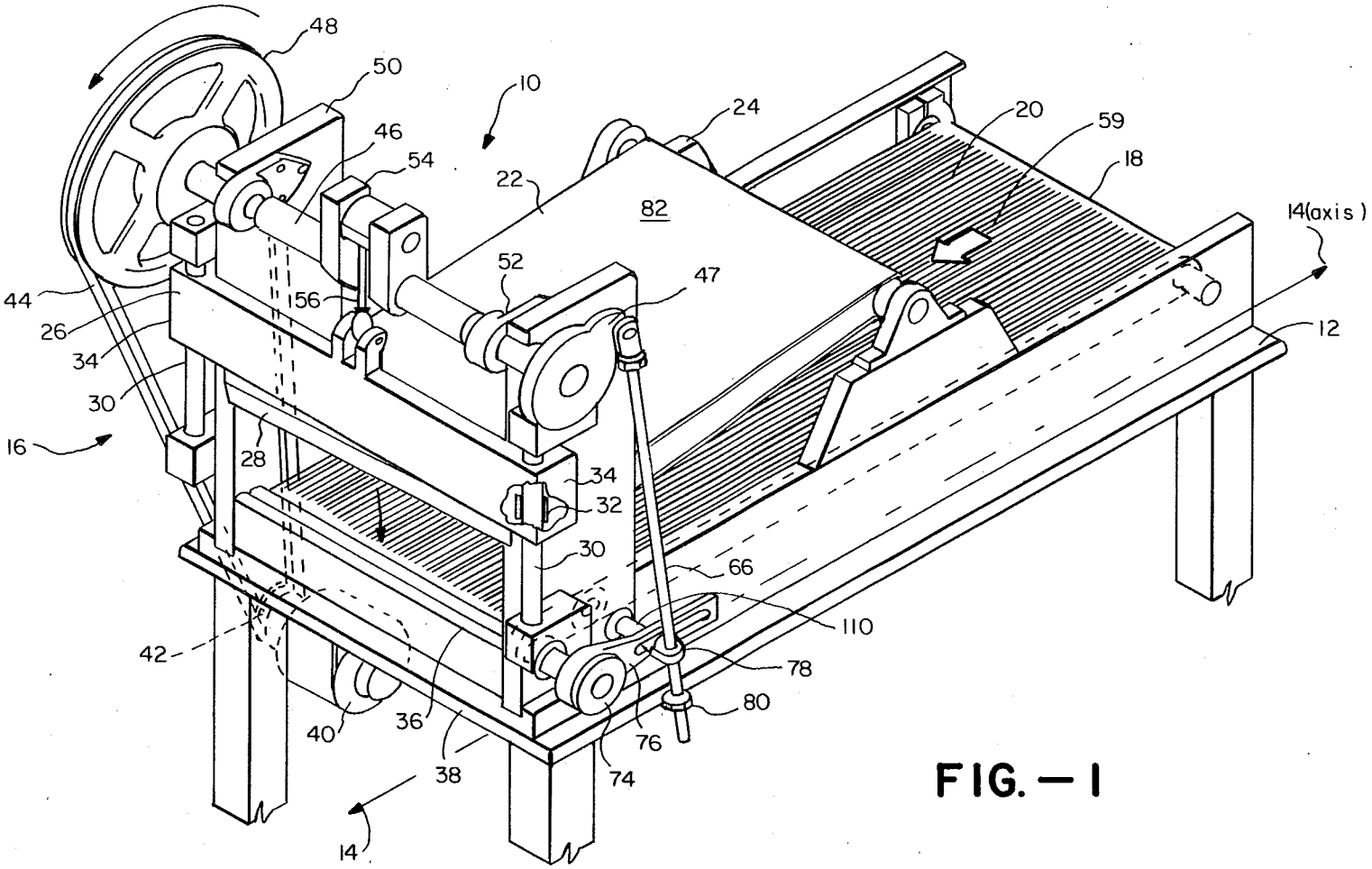
FIG. 1 is a perspective view of the cutting apparatus in accordance with this invention.
Figure 2:
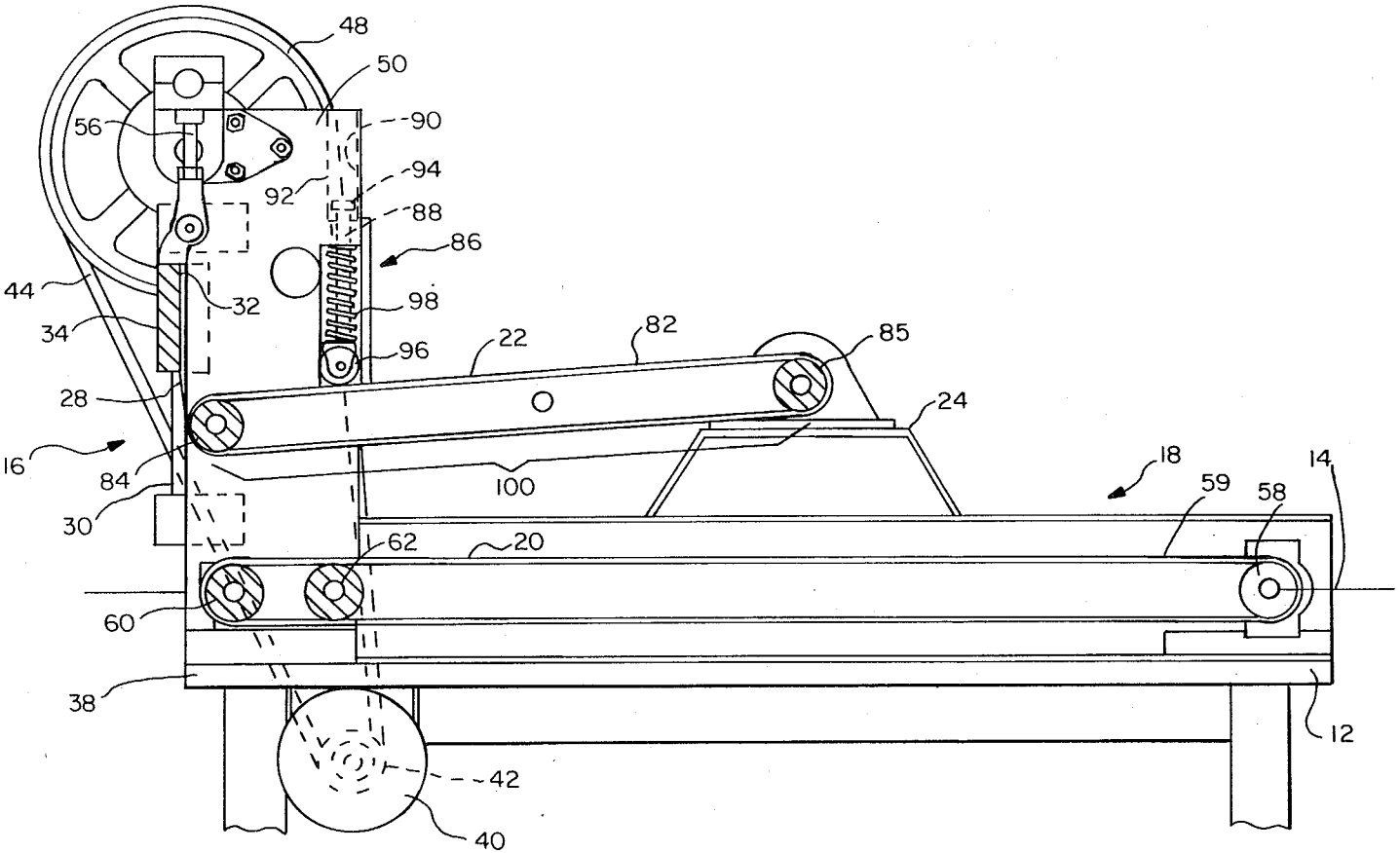
FIG. 2 is a side elevational view of the cutting apparatus in accordance with this invention.

Referring to the drawings, wherein like-reference characters designate like or corresponding parts throughout the several views, and referring particularly to FIGS. 1 and 2, there is shown the invention, generally indicated by numeral 10, which is a cutting apparatus for cutting living plant material. The cutting apparatus 10 includes a frame 12 having a horizontal axis 14.

Attached to a frame 12 is a reciprocating cutting assembly 16. The cutting assembly 16 is fixedly mounted at one end of the frame 12. The frame 12 includes means shown generally by numeral 18 for feeding the living plant material to the cutting assembly 16. The feed means 18 includes a conveyor belt 20 which defines a load surface, which moves toward the cutting assembly 16 and generally parallel to the horizontal axis 14. Also attached to the frame 12 is a hingedly mounted upper pressure surface 22. The pressure surface 22 is mounted to a bearing block 24 at one end and is free to pivot about the one end at the other end. As living plant material is fed to the cutting assembly 16, gradually increasing pressure is applied by the pressure surface 22 against the living plant material on the lower surface, compressing the material for cutting.

With particular reference to FIGS. 1 and 2, the preferred embodiment of the cutting assembly 16 is shown. The cutting assembly 16 includes an upper knife mounting block 26 having an upper knife 28 mounted in the block 26. The block 26 is slideably connected to guide pins 30. The guide pins 30 are precision ground so that the clearance between the upper knife 28 and a lower knife 36 is minimized and approaches zero. The block 26 has two linear ball bearings 32 at respective ends 34. Thus, the block 26 slideably engages the guide pins 30 with ball bearings 32 to ensure an even cutting stroke and operation of the upper knife 28. The ball bearings 32 combine with precision ground guide pines 30 reduces wear of the cutting assembly 16 and thus the low clearance between the upper knife 28 and the lower knife 36 can easily be maintained for long periods of continuous use.

The upper knife 28 has a cutting plane defined by the guide pins 30 and the lower knife 36 has a cutting plane which is generally aligned with the upper knife cutting plane. Both cutting planes are generally perpendicular to the horizontal axis 14. With the close tolerances, as discussed above, the knives maintain their sharpness through long periods of continuous use.

The knives 28 and 36 are each made from hardened and tempered high speed steel and ground to a high degree of sharpness with a shear angle of approximately 3° 45′. It has been found that such a shear angle achieves clean cuts of green tobacco leaves. The hardened and textured steel edge reduces wear on the cutting edge without brittleness which can result in chipping of the edges of the knives 28 and 36.

The cutting assembly 16 further includes a motor 40 having a pulley 42 which is connected to pulley belt 44. The pulley belt 44 is connected to an eccentric cam shaft 46 at a drive pulley 48. The eccentric cam shaft 46 is connected to the frame 12 by support members 50. The cam 46 includes bearing blocks 52 which permit rotation of cam 46. The cam 46 includes an eccentric portion 54 which is attached to upper mounting block 26 through a connecting rod 56.

The motor 40, mounted below a table 38, drives the cutting assembly 16. The motor 40 turns a drive shaft (not shown) with a rotary motion. The rotary motion is imparted to pulley 42 which rotates belt 44. Belt 44 rotates cam 46 through drive pulley 48. When the cam 46 is in the position where the eccentric portion 54 reaches its highest point, the upper knife 28 is in the open position and ready to begin the cutting stroke.

As the cam 46 continues to rotate, the upper knife 28 moves down. As the cam 46 further rotates, the eccentric portion 54 drives the upper knife 28 down to its lowest position, at 180° of rotation of the cam 46. In the lowest position, the cutting stroke is complete. As the cam 46 continues its rotation, the upper knife 28 is raised. The upper knife 28 continues to rise until reaching its highest point. At that time, the cam 46 completes one cycle.

The rotation motion of motor 40 is translated to a reciprocating motion through cam 46. Eccentric portion 54 exaggerates the reciprocal motion and moves the upper knife in a reciprocal manner through connecting rod 56.

Figure 3:
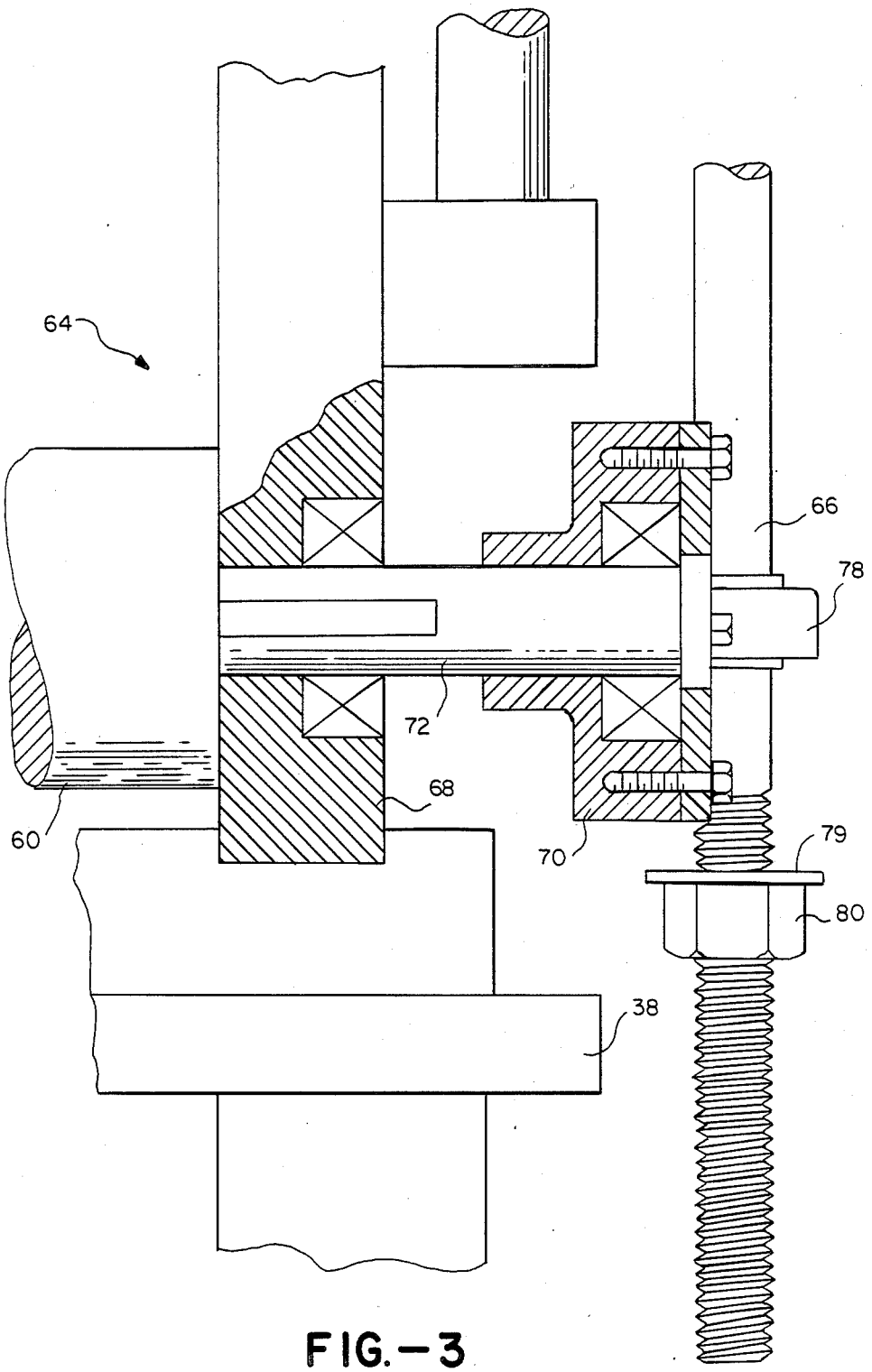
FIG. 3 is a partial sectional, elevated view of the clutch assembly of the cutting apparatus in accordance with this invention.

The feed means 18 will now be explained with particular reference to FIGS. 1, 2, and 3. The feed means 18 includes continuous conveyor belt 20. The conveyor belt 20 is fixed between rollers 58 and 60 (see FIG. 2). An additional roller 62 is provided adjacent to roller 60 to keep tension on conveyor belt 20 just before the living matter is cut by cutting assembly 16.

The feed means 18 is driven by motor 40 synchronously with the cutting assembly 16 (see FIG. 1). Roller 60 is a drive roller which is rotated through a clutch assembly shown generally by numeral 64. The rotational movement of cam 46 moves the roller 60 through a connecting rod 66 and a shaft 72.

The connecting rod 66 is connected to one end of the cam 46 at a conveyor feed cam 47. As the cam 46 rotates, it drives the connecting rod 66 up and down in a reciprocating manner, thereby changing the rotational motion of the cam 46 into translational movement of the rod 66. The translational movement of the rod 66 is synchronized with the reciprocal movement of the upper knife 28. Thus as the cam 46 drives the upper knife 28 downward, through its cutting stroke, it also drives the rod 66 downward. Likewise, as the cam 46 lifts the upper knife 28 upward, through its upward stroke, the rod 66 is also raised.

The conveyor belt 20 is only driven forward during the upward stroke of the knife 28. This is accomplished by means of the clutch assembly 64. Clutch assembly 64 engages conveyor roller 60 on the upward stroke, thereby moving the belt 20 toward cutting assembly 16. The clutch assembly 64 disengages the roller 60 on the downward or cutting stroke, whereby the upper knife 28 cuts the living plant material when the belt 20 is still. Thus, the reciprocal movement of the knife 28 is synchronized with the movement of the belt 20.

Figure 4:
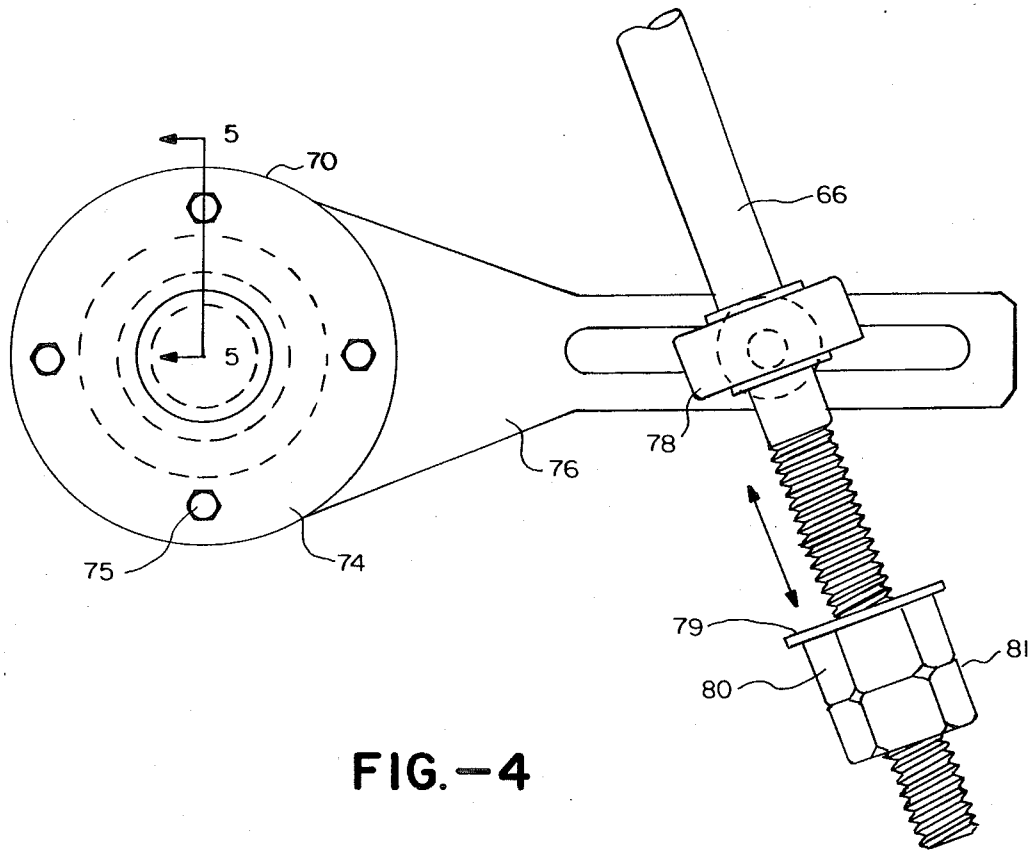
FIG. 4 is a side view of one bearing in the clutch assembly.
Figure 5:
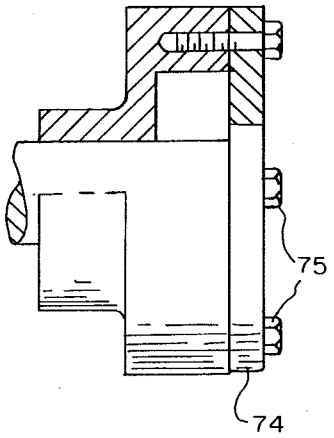
FIG. 5 is a cross-sectional of the clutch bearing of FIG. 4 taken along lines 4—4 in the direction of the arrows.

The detailed structure and operation of the clutch assembly 64 will now be explained with particular reference to FIGS. 3–5. The clutch assembly 64 includes two one-way clutch bearings 68 and 70. Clutch bearing 68 is connected to conveyor roller 60 through a conveyor roller drive shaft 72. Clutch bearing 70 is enclosed in a housing 74 as best seen in FIG. 4. The housing 74 is fastened to clutch bearing 70 by screw fastening members 75, as best seen in FIG. 5. The bearing 70 is also connected to drive shaft 72 of conveyor roller 60. The housing 74 is connected to the connecting rod 66 through a housing connecting member 76 at rod joint 78. The rod 66 includes a stop nut 80 for limiting travel of the rod 66 on the upward stroke.

The rotary motion generated by the cam shaft 46 at the conveyor feed cam 47 is translated into synchronous reciprocal movement of the rod 66 and translated back to rotational movement at the clutch assembly 64 through rod joint 78. The rod 66 is free to move downward on the cutting stroke, through the joint 78. Upon upward movement of the rod 66, a stop nut 80 contacts the rod joint 78. The stop nut 80 is fixed in position by a support nut 81 which prevents slippage of the stop nut 80. Further upward movement of the stop nut 80 causes the rod joint 78 to also move upward, imparting a rotational force to housing connecting member 76. This force causes the clutch housing 74 to rotate. The rotational movement of the housing causes clutch bearing 70 to drive conveyor roller 60 causing forward movement of the conveyor belt 20. The stop nut 80 is set so that the conveyor 20 moves toward the cutting plane only after the cutting blade 28 is moved out of the path of the bundles of tobacco; that is, only after the cutting blade has been raised beyond the preset maximum height of the bundles of tobacco leaves on the conveyor belt 20.

On the downward stroke of the rod 66, the clutch housing 74 is allowed to fall back by its own weight onto a fixed stopper 110 on the frame 38 so that it remains essentially horizontal as shown in FIG. 1, thereby completing a cycle. It can once again be seen that on the upward stroke the belt 20 is caused to move, while on the downward or cutting stroke the belt is still, allowing the living plant material to be cut.

The stop nut 80 is adjustable. If the stop nut 80 is moved closer to the rod joint 78, the strip width of the living plant material will be larger, while if the nut 80 is moved farther away from the joint 78, smaller strip width will result. Thus, the forward movement of the feed means 18 is adjustable by stop nut 80.

The clutch bearing 68 is used to ensure there is no backward movement of the conveyor roller 60. Because bearing 68 is a one-way bearing, it prevents the conveyor roller 60 from moving backwards on the downward stroke.

With particular reference to FIGS. 1 and 2, the detailed structure and operation of the upper pressure surface 22 will now be described. The pressure surface 22 gently compresses the bundles of varying heights of living plant material entering the cutting assembly 16 for cutting. Pressure surface 22 accomplishes this by compressing the living plant material, just prior to the living plant material entering the cutting plane of the upper and lower knives, 28 and 36, respectively (see FIG. 6). The pressure surface 22 is hingedly connected to the frame 12 at one end by bearing block 26.

The pressure surface 22 is defined by an upper conveyor belt 82 having a free moving first end 84 and a second end 85 connected to the bearing block 24. Each of the ends 84 and 85 comprises a roller. The upper conveyor belt 82 includes a spring loaded member shown generally by numeral 86 (FIG. 2). The spring loaded member 86 includes a moveable rod 88 mounted in a channel 90 on the cutting assembly support member 50. The channel 90 necks down at channel end 92 to limit further travel of rod 88. Rod 88 includes an enlarged end 94 which together with channel end 92 prevents travel past end 92. The rod further includes a roller end 96 which contacts the upper conveyor belt 82. The rod 88 is normally urged downward into contact with belt 82 by a spring 98 between the rod ends 94 and 96. The roller end 96 allows free movement of the belt 82 while exerting an essentially constant pressure on the belt 82.

The upper conveyor belt 82 has a broad area for applying pressure on living plant material shown as compression zone 100 in FIG. 2. The weight of the upper conveyor belt 82 and the rollers 84 and 85 as well as the pressure from the spring member 86 causes a lever-like, gradually increasing pressure to be exerted on living plant material on the load surface prior to entering the cutting assembly 16. It will be noticed that this pressure is exerted over the broad area of compression zone 100. The gradual pressure and the broad area over which that pressure is exerted allows the living plant material to be compressed without damage. This also enables bundles of living plant material which have non-uniform thickness (height) to be fed into the space between the fixed roller 85 and the load surface 20 at feed area 59 without stopping for reorganizing and re-loading. It will also be appreciated that the first end 84 is located in close proximity to the cutting planes to keep the material being cut compressed as much as possible just prior to cutting.

In Use

Figure 6A:
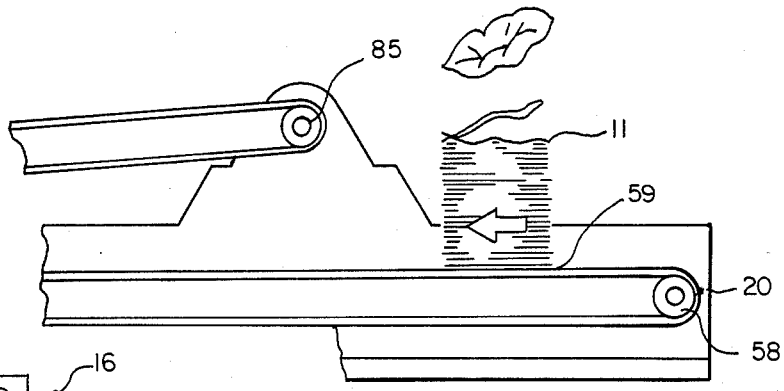
FIGS. 6*a*–6*c* are schematic representation of the cutting apparatus in accordance with this invention in operation.
Figure 6B:
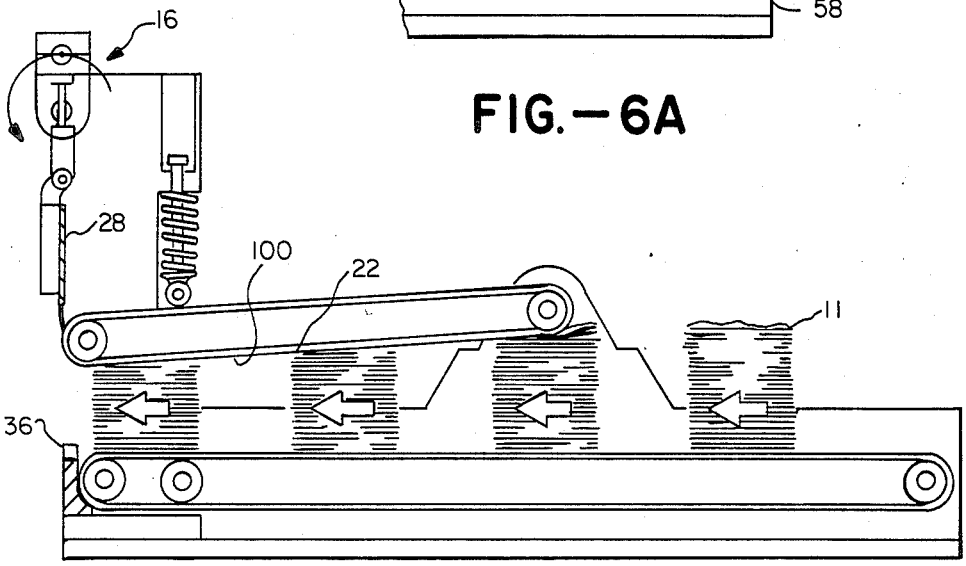
Figure 6C:
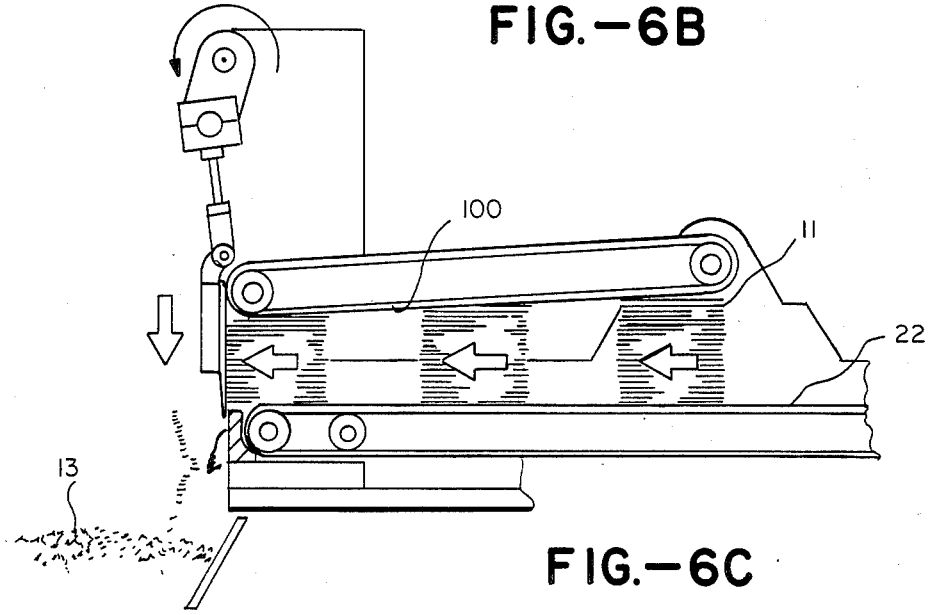

With particular reference to FIG. 6, the operation of the cutting assembly in accordance with this invention will be explained. First the green tobacco leaves 11 are folded and bundled and then loaded continuously on the feed means, conveyor belt 20, at feed area 59 between the fixed roller 85 and the conveyor belt 20. On the upward stroke of the knife 28, the feed means conveyor belt 20 moves forward toward cutting assembly 16 in the direction of the arrow. As the tobacco leaves 11 move closer to cutting assembly 16, they are compressed by pressure surface 22 at compression zone 100. Gradually increasing pressure is applied to the tobacco leaves 11 by the pressure surface 22. The maximum amount of pressure is exerted by the pressure surface 22 just prior to the living plant material entering the cutting plane. The living plant material is cut by upper and lower knives, 28 and 36, respectively. After cutting the leaves 11, the strips 13 are collected.

The strip width of the cuts can be adjusted by stop nut 80 as described earlier. The cuts have generally been found to be uniform and in the case of green tobacco leaves. A minimum amount of tobacco juice, nicotine and the like has been found to flow.

Generally speaking, the cutting apparatus 10 has been found to cut at a rate of up to 300 strokes per minute with a capacity of 110 kg/hr of green tobacco leaves. Ninety percent of the green tobacco leaves tested has been found to have the desired strip width. In addition, using high speed steel, hardened and tempered blade, described above with reference to knives 28 and 36, six hours of continuous use of the cutting apparatus was possible with the results being 90% or more acceptable.

The invention has been described with specific reference to an embodiment for cutting green tobacco leaves. It will be appreciated that variations in the above described structure can be made within the scope of this invention. It will also be appreciated that the cutting apparatus in accordance with this invention may be used with materials other than green tobacco leaves. For example, raw vegetables are capable of being cut by this apparatus. Therefore, the scope of the invention is not to be limited to the above detailed description or examples, but rather only to the claims as appended below.

We claim:

1. An apparatus for cutting bundled tobacco leaves, comprising:

cutting means, having a cutting blade coupled to a blade driving means, for cutting bundled tobacco leaves along a cutting plane defined by the cutting blade;

conveying means for conveying the bundled tobacco leaves on a conveying surface to the cutting plane, the bundled tobacco leaves having a thickness perpendicular to the conveying surface less than a preset maximum thickness at the cutting plane;

blade driving means for driving the cutting blade along the cutting plane in a downward stroke and an upwad stroke, the blade cutting bundles within the cutting plane in the downward stroke and the blade withdrawing in the upward stroke above the preset maximum thickness over the conveying surface; and conveyor driving means, coupled to the conveying means and the blade driving means, for driving the conveying surface so that the conveying surface does not move toward the cutting plane while the cutting blade is less than the preset maximum thickness from the conveying surface and the conveying surface moves a preset distance toward the cutting plane when the cutting blade is more than the preset maximum thickness from the conveying surface wherein the blade driving means includes:

a rotating cam shaft;

means, coupled between the cam shaft and the cutting blade, for translating rotation motion of the cam shaft into reciprocating motion to drive the cutting blade in the upward and downward strokes; and wherein the conveyor driving means includes:

a conveyor cam mounted on the cam shaft of the blade driving means for translating rotation motion of the cam shaft into a reciprocating motion to supply an upward motion and a downward motion synchronized with the upward and downward strokes of the cutting blade;

connecting rod means, having a first end and a second end, connected to the conveyor cam at the first end and having an ajustable stop near the second end, for supplying the reciprocating motion;

a rod joint having a passage receiving the connecting rod means between the first end and the adjustable stop adapted to allow movement of the connecting rod means through the passage unless contacted by the adjustable stop during an upward motion;

a drive cam, coupled to the connecting rod means through the rod joint so that the connecting rod means engages the drive cam when the adjustable stop contacts the rod joint during the upward motion; and a one way clutch coupled to the drive cam and the conveyor means so that the conveyor surface moves only in the direction of the cutting plane in response to the motion of the drive cam, the position of the adjustable stop on the connecting rod resulting in movement of the conveyor surface while the cutting blade is above the preset maximum thickness and setting the preset distance of the movement.

2. The apparatus of claim 1, wherein the conveyor driving means includes adjustment means for adjusting the preset distance, whereby the width of strips of tobacco leaves cut is adjustable.

3. The apparatus of claim 1, wherein the cutting means includes a lower blade fixed adjacent to the cutting surface and the cutting blade is mounted at a shearing angle with respect to the lower blade so that a slicing action is achieved in the downward stroke.

4. The apparatus of claim 3, wherein the shearing angle is 3 degrees 45 minutes.

5. The apparatus of claim 1, wherein the connecting rod means is a rod having threads adjacent to the second end, and the adjustable stop is a stop nut adapted to the threads.

6. The apparatus of claim 1, wherein the conveying means includes:

means, mounted above the conveying surface and the bundled tobacco leaves, for applying pressure to the bundled tobacco leaves adjacent to the cutting plane so that the leaves are firmly held during the downward stroke of the cutting blade without substantial crushing of the leaves.

7. The apparatus of claim 6, wherein the means for applying pressure includes:

an upper conveyor, having a proximal end adjacent to the cutting plane and a distal end away from the cutting plane, with a distal roller at the distal end mounted at a height above the conveying surface greater than the preset maximum thickness and a free roller at the proximal end free to move in a direction essentially perpendicular to the conveying surface, and having an upper conveyor surface on the plane defined by the free roller and the distal roller, the weight of the upper conveyor causing the free roller to pivot on the distal roller and apply pressure to the bundled tobacco leaves on the conveying surface.

8. The apparatus of claim 7, wherein the upper conveyor further includes:

means for exerting essentially constant pressure near the free roller.

* * * * *